US007959033B2

(12) United States Patent
Leggett

(10) Patent No.: US 7,959,033 B2
(45) Date of Patent: Jun. 14, 2011

(54) DRIP CATCHER

(76) Inventor: James Francois Leggett, Tacoma, WA (US)

( * ) Notice: Subject to any disclaimer, the term of this patent is extended or adjusted under 35 U.S.C. 154(b) by 357 days.

(21) Appl. No.: 12/284,073

(22) Filed: Sep. 18, 2008

(65) Prior Publication Data

US 2010/0065583 A1 Mar. 18, 2010

(51) Int. Cl.
*B67D 1/16* (2006.01)

(52) U.S. Cl. ..... 222/108; 222/129; 222/566; 137/312; 141/86; 141/88

(58) Field of Classification Search ..... 222/571–572, 222/566, 129, 108, 111; 137/312–314; 141/86–88; 220/571

See application file for complete search history.

(56) References Cited

U.S. PATENT DOCUMENTS 555,820 A * 3/1896 Kaup ..... 248/212
699,481 A * 5/1902 Boyd ..... 222/108
702,181 A * 6/1902 Boyd ..... 222/108
1,703,284 A 2/1929 Wolfe
5,470,011 A 11/1995 Jordan
5,690,138 A 11/1997 Fuller
5,960,995 A 10/1999 Leatherman
6,164,347 A * 12/2000 Dahlmann ..... 141/370
6,279,781 B1 8/2001 Konar
6,779,688 B1 * 8/2004 Mayer ..... 222/108
6,968,979 B2 11/2005 Gribble
7,216,778 B2 5/2007 Kaeb

* cited by examiner

*Primary Examiner* — Frederick C. Nicolas
(74) *Attorney, Agent, or Firm* — James F. Leggett

(57) ABSTRACT

A drip catcher, having an adjustable neck, having a hook at the top for engaging a spout pipe of a fluid reservoir, and a basin, containing an absorbent pad and three sided slot on the flattened rear side to accommodate two legs of an alligator clasp in the neck, having a channel between the legs created by cutting three sides of a brace, bendable rearward to support the invention in vertical alignment to the spout, teeth extending from the outside edge of both legs which engage the sides of the slot, so the teeth disengage by squeezing the legs together.

3 Claims, 8 Drawing Sheets

DRIP CATCHER

BACKGROUND OF THE INVENTION

This invention relates generally to an improved device for catching drips from the spout of a dispensing reservoir for liquids such as coffee, which device removably attaches to the pipe which conveys fluid to a spout, to include reservoirs having the spout protected by a band affixed around it, and suspends a basin below the outlet of the spout, which basin may be provided with a removable absorbent pad, and integrally contains a means to align the device directly beneath the spout.

There have been previous attempts to solve the problem of drips from the spout of a dispensing reservoir which stain table linen upon which the reservoir is resting or even creating a slipping hazard where the drips collect on the floor below the counter upon which the reservoir is resting. Prior art has included basins affixed to plates upon which the reservoir is placed, such as Leatheran et al, U.S. Pat. No. 5,960,995 and Gribble et al, U.S. Pat. No. 6,968,979 B2, or basins to be suspended from the neck of the spout of the reservoir, such as Jordon, U.S. Pat. No. 5,470,011, and Fuller, U.S. Pat. No. 5,690,138 which rely upon the side of the table or counter upon which the reservoir rests to align the basin with the outlet of the spout. Another means known to align a basin below the spout is mechanical attachment of the top of the basin to the neck of the spout by engagement of ribs in the spout, such as Konar, U.S. Pat. No. 6,279,781 B1, or physically clamping the top of the basin to the neck of the spout, such as Wolfe, U.S. Pat. No. 1,703,284. Kach, U.S. Pat. No. 7,216,778 B2 discloses a "self-leveling" drip catcher which tries to solve the alignment problem by off-setting the center of gravity to the rear of the vertical axis of the basin. Further overly complex attempts to solve the problem are disclosed in Boussemart U.S. Patent Application No. 20070209521 and Cahen, U.S. Patent Application No. 20070000944.

The limitations of the prior art are: 1. None are removably attachable to the neck of a spout which is protected by a band encircling the spout, which is done to protect the spout from damage when the reservoir is being transported or from incidental impact when in use. 2. None are short enough to function with dispensing reservoirs, such as those currently in use by Starbucks and other major franchises. 3. None are provided with a removable absorbent pad which allows emptying of the basin without removing it from the neck of the reservoir. 4. None are designed to be inexpensively manufactured in two parts, the neck and the basin, with the ability to adjust the height of the device to accommodate different dispensing reservoirs. 5. None are provided with an integral means to align the basin with the outlet of the spout.

It is an object of this invention to provide a basin and means for removably suspending it from the neck of a spout of any dispensing reservoir and an integral means for aligning the basin directly below the outlet of the spout. It is a further object of this invention to provide a removable absorbent pad within the basin so that accumulated fluid can be removed from the basin without the need to detach the basin from the reservoir. It is a further object of this invention to provide for inexpensive manufacture of the device in two parts, the hook neck extension, which engages the spout pipe and is adjustable in length at its attachment point to the basin, and the basin.

Other objects, features and advantages of the invention will be apparent from the drawings, the specification and the claims.

SUMMARY OF INVENTION

This invention satisfies these objects in that it is comprised of a neck, adjustable in length, with a hook at the top for engaging a spout pipe protruding from the side of a fluid reservoir, and a fluid tight basin containing a removable absorbent pad and having a three sided slot extending from the flat rear side of the basin to accommodate the two legs of an alligator clasp at the end of the neck opposite to the hook, said alligator clasp having teeth extending from the outside edge of both legs which engage the sides of the slot and the neck having a channel created by cutting three sides of a brace from the center of the neck parallel to and extending the length of the legs, said channel being of sufficient width so that the alligator clasp legs may be squeezed together to disengage the teeth from the sides of the slot, while the brace remains attached at its top end to the neck and can be bent rearward from the neck to contact the side of the fluid reservoir or support for the fluid reservoir so that the basin is maintained in vertical alignment with the outlet end of the spout, and the hook is offset from the alligator clasp so that the vertical axis of the fluid drip catcher is aligned with the outlet spout.

The novel features of the invention will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

DESCRIPTION OF THE PREFERRED EMBODIMENTS

Figure 1:
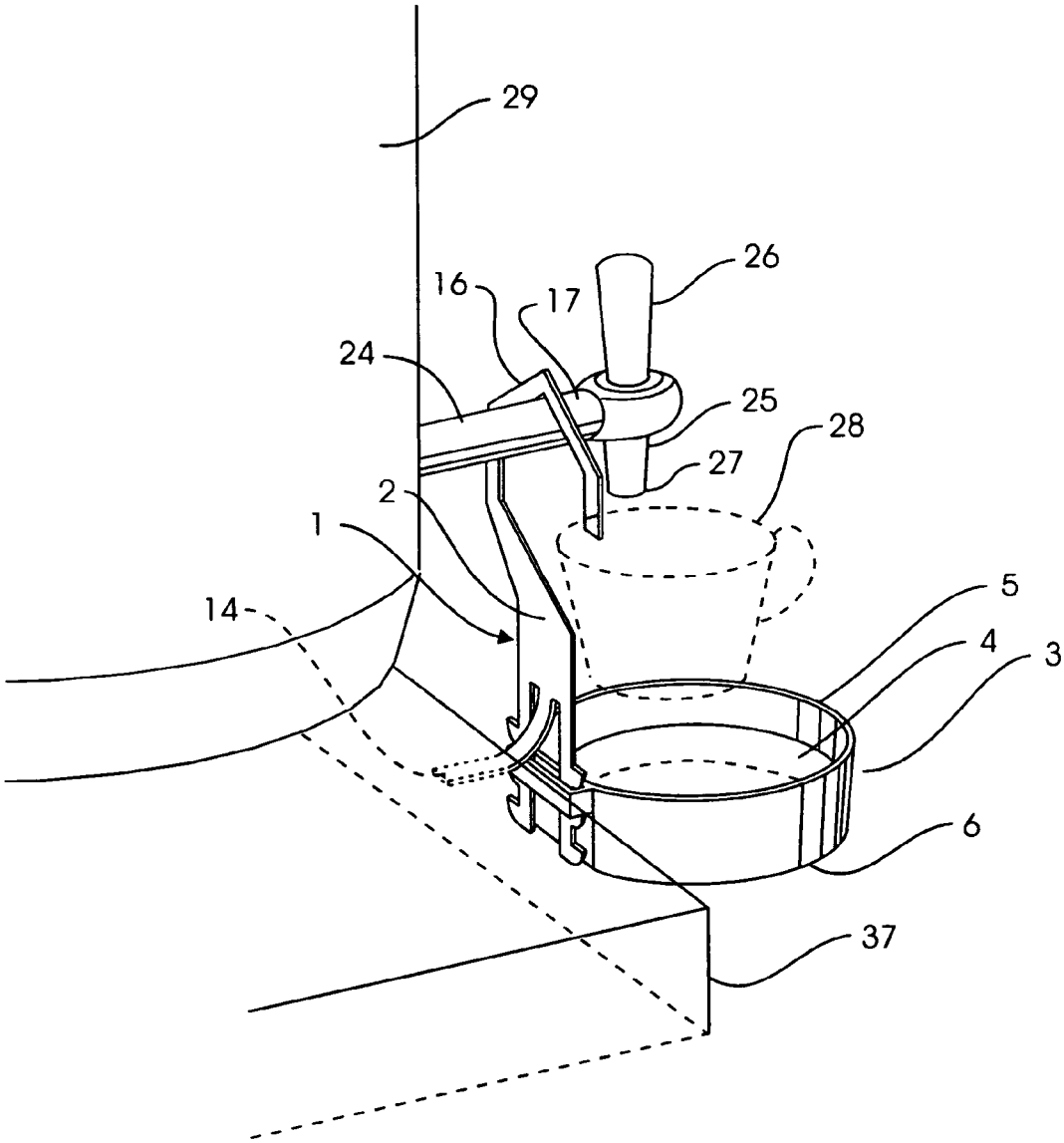
FIG. 1 is a right side perspective view of the invention installed on a reservoir.
Figure 2:
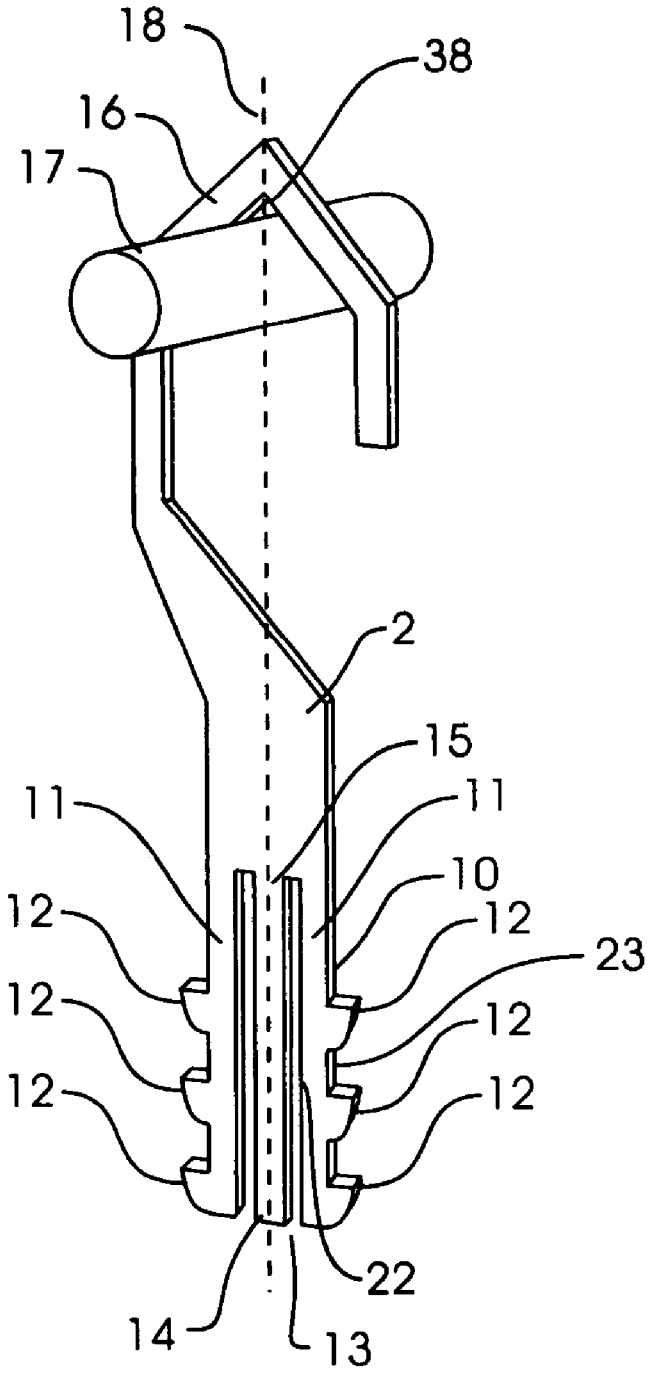
FIG. 2 is a front perspective view of the neck portion of the invention.
Figure 5:
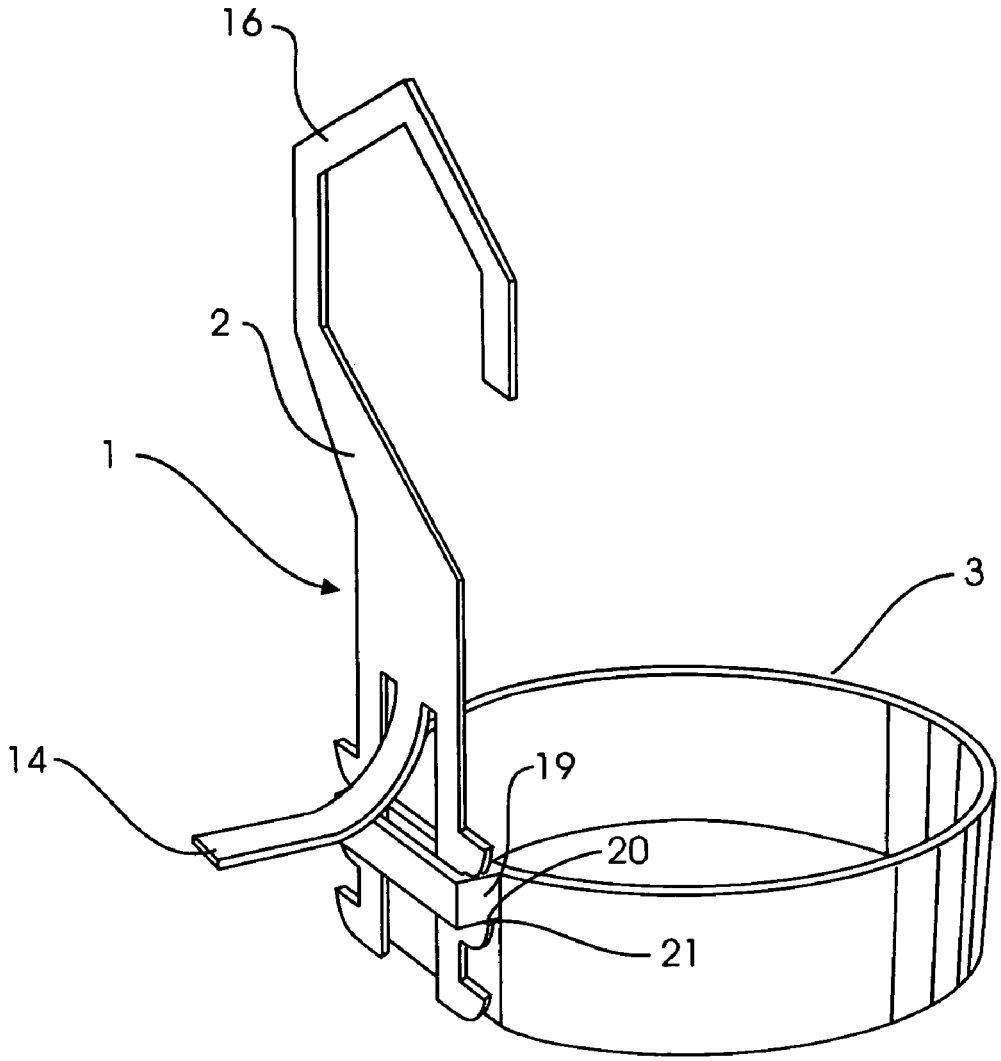
FIG. 5 is a rear perspective view of the engagement of the neck on the basin.

With reference to FIGS. 1, 2 and 5, the Drip Catcher (1) is shown in its preferred embodiment as installed on the spout pipe (17) extending from the exterior face of a fluid reservoir (29). The hook (16) partially encircles the spout pipe (17) between the reservoir (29) and its spout (25) so that the Drip Catcher (1) hangs beneath the spout outlet (27) and the hook (16) is formed in a tapered inverted 'V' (38) so as to maintain correct alignment of the basin (3) directly below and in line with the vertical axis (18) of the spout (25). The hook (16) extends from the extreme edge of the top of the neck (2) and is displaced from the vertical axis (18) of the spout pipe (17) the diameter of the spout pipe (17) so that when the hook (16) rests upon the spout pipe (17) the basin (3) is directly below the spout outlet (27). The neck (2) is provided at its lower end with a means to adjust the distance from the hook (16) to the basin (3) so as to accommodate different size cups (28) between the top of the basin (5) and the spout outlet (27), which adjustment means is comprised of an alligator clasp (10) in the lower end of the neck (2) formed by cutting three sides of a brace (14), with the top of the brace (15) remaining attached to the neck (2), which brace (14) is bent rearward away from the basin (3) a sufficient distance to touch the face of the fluid reservoir (29) or the counter (37) upon which the fluid reservoir (29) rests thereby aligning the basin (3) with the spout outlet (27), the result of removing the brace (14) from the neck (2) is to form two legs (11) extending downward from the hook (16), which legs are provided along their outside edge (23) a series of equally spaced teeth (12) having the top of the teeth (21) a flat face perpendicular to the neck, which top edge of a pair of teeth, extending from the outside edge of both legs (23) engages the sidewalls (19) of a slot (8) formed on the flattened rear wall (7) of the basin (3). The channel (13) formed in the neck by removal of the brace (14) is of sufficient width to that the two legs (11) may be squeezed together a sufficient distance to disengage the teeth (12) from the sidewall of the slot (19) to change the overall length of the Drip Catcher (1) or disassemble the neck (2) from the basin (3).

With reference to FIG. 1, the basin (3) is shown with a disposal absorbent pad (4).

Figure 6:
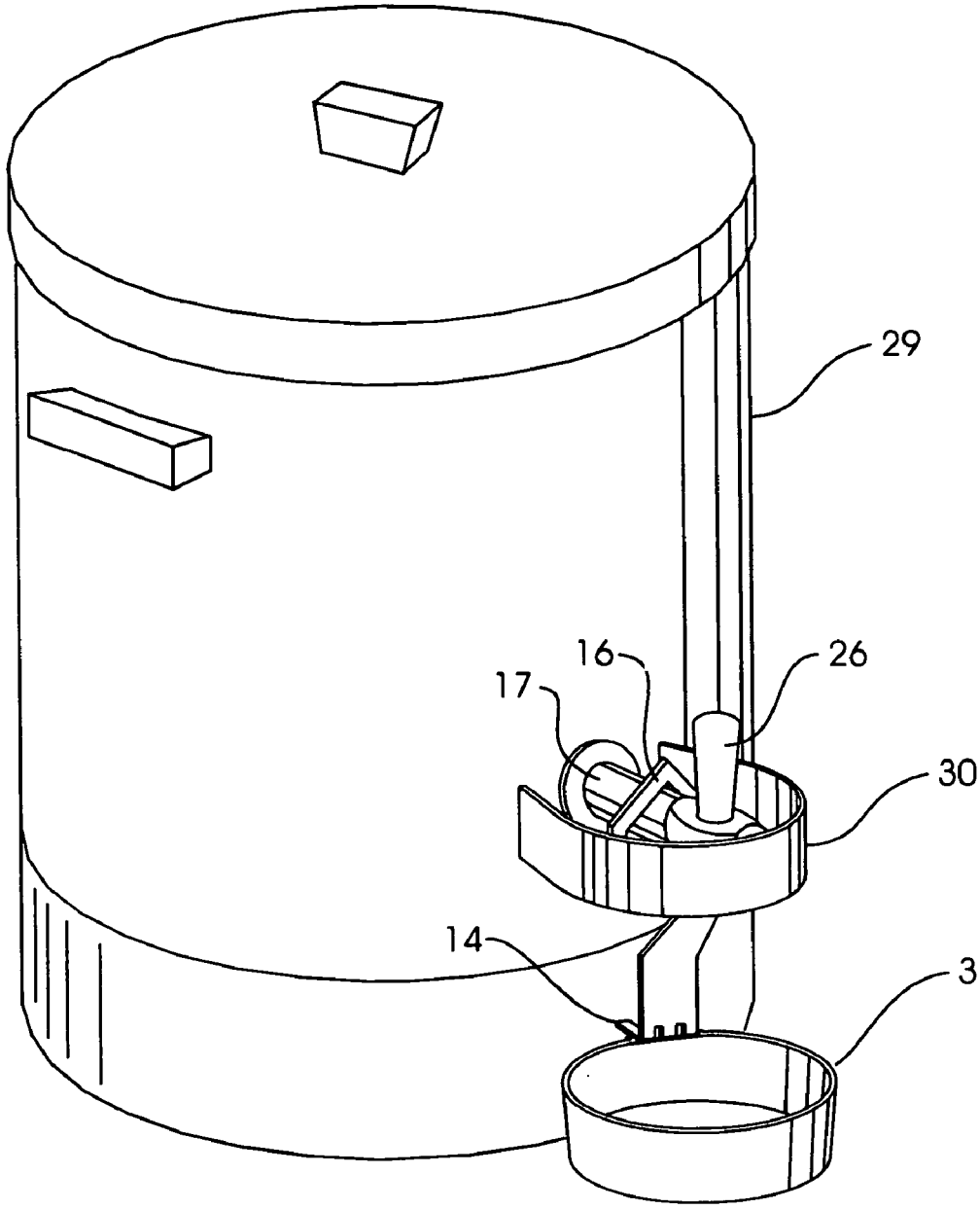
FIG. 6 is an aspect view of the invention installed on a reservoir equipped with a protective band over its spout.

With reference to FIG. 6, the Drip Catcher (1) is shown installed upon a fluid reservoir (29) equipped with a protective band (30) to prevent damage to the spout (25) when in transit. The access to the spout and spout pipe (17) in this arrangement is severely limited so that the neck (2) of the Drip Catcher (1) is rotated 90 degrees from its designed alignment and inserted under the protective band (30) until the hook (16) is above the top edge of the spout pipe (24) then again rotated 90 degrees so that the hook (16) extends over and engages the spout pipe (17).

Figure 3:
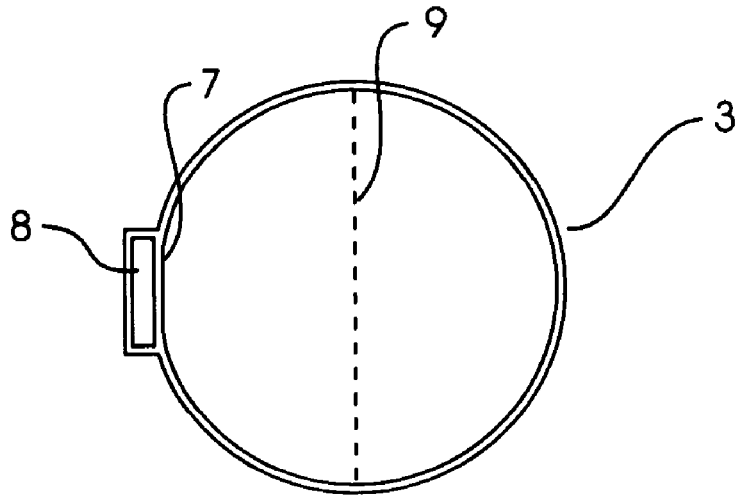
FIG. 3 is a top perspective view of the basin portion of the invention.
Figure 4:
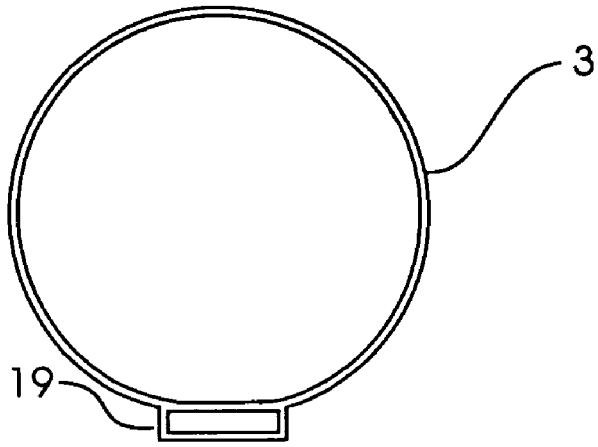
FIG. 4 is a top perspective view of the rear of the basin portion of the invention.

Because of the various designs of fluid reservoirs (29), especially the confined dimensions of the fluid reservoir (29) with the protective band (30) utilized by commercial coffee companies, such as Starbucks, the preferred embodiment of the Drip Catcher (1) has defined dimensions. The basin (3) is 2 inches high with an open top (5) and fluid tight bottom (6), being 4 inches in diameter (9), and fitted with a disposable absorbent pad (4) 1 inch thick and slightly less that 4 inches in diameter so as to fit within the interior of the basin (3). With reference to FIGS. 3, 4 and 5, the rear wall (7) of the basin (3) is flattened and to which is affixed a three sided slot (8) being 1 inch wide and having side walls (19) extending perpendicular out from the rear wall (7) and being no higher than the distance between the teeth (12) on the legs (11) of the neck (2), which teeth (12) protrude from the outside edge (23) of both legs a distance of ¼ inch, so that the basin (3) is supported by the bottom edge of the sidewalls (20) of the slot communicating with the top edge (21) of the teeth (12) of the alligator clasp when the legs (11) are in the neutral position. The top of the first set of teeth (12) nearest the hook (16) is 6½ inches from the top of the hook (16). The top of the second set of teeth (12) is 7 inches from the top of the hook (16) and the top of the bottom set of teeth is 7½ inches from the top of the hook (16), so that the minimum distance between the top of the spout pipe (17) and the bottom (6) of the basin (3) is 8 inches and the maximum distance between the top of the spout pipe (17) and the bottom (6) of the basin (3) is 9 inches. This allows the basin (3) to be placed below the spout outlet (27) a distance to accommodate various sizes of cups (28).

Due to the force of gravity, the basin (3) tends to rotate around the hook (16) toward the surface of the reservoir (29), so that a brace is necessary to restrict said rotation and thus maintain the relation of the basin (3) directly beneath the spout outlet (27). The brace (14) is bent rearward from the top of the brace (15) which remains attached to the neck (2) at the top of the channel (13) until it makes contact with either the face of the fluid reservoir (29) or the counter or stand upon which the fluid reservoir (29) is resting. Thus the basin (3) is maintained in vertical alignment with the spout outlet (27) to catch any drips from said spout (25) when there is not a cup (28) located underneath the spout outlet (27) or overflow from said cup (28). The disposable absorbent pad (4) can be removed and replaced without disturbing the position of the Drip Catcher (1) on the spout pipe (17).

Figure 7:
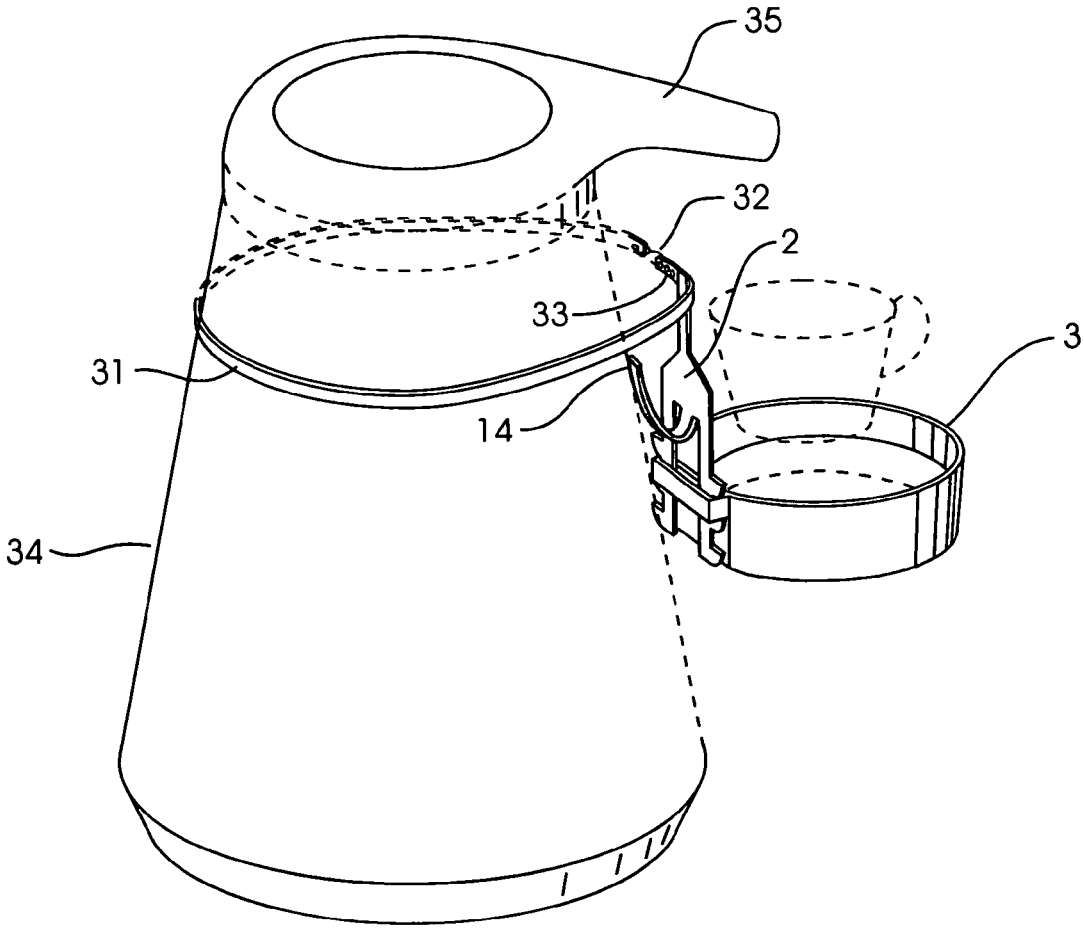
FIG. 7 is an aspect view of an alternative embodiment of the invention used in conjunction with another version of a portable fluid reservoir.
Figure 8:
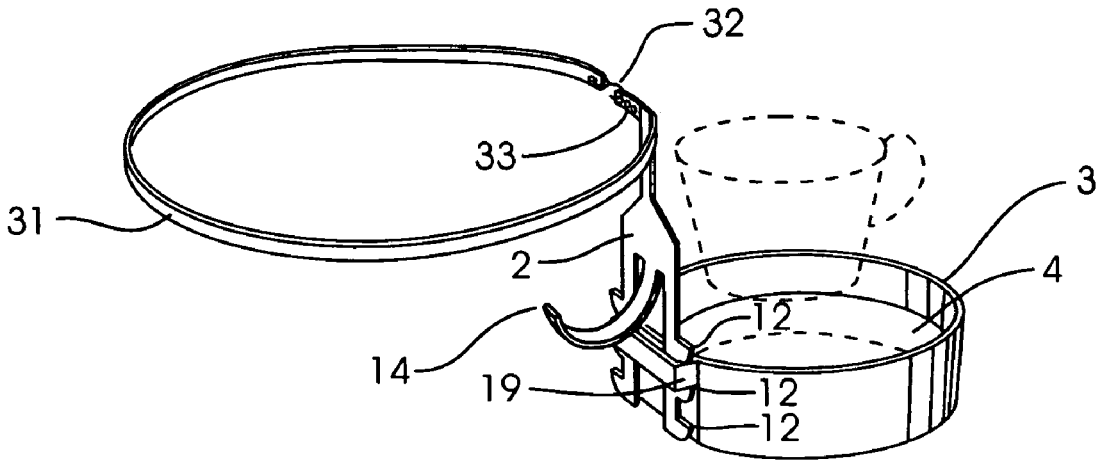
FIG. 8 is an aspect view of the alternative embodiment of the invention.

In an alternative embodiment of the invention, as shown in FIGS. 7 & 8, the invention is adapted to fit on a portable fluid reservoir (29) which has sides that flare (34) as they descend from the top which has a tapered spout (35) which will not restrain the hook (16) in the preferred embodiment. The neck (2), brace (14), alligator clasp (10) and basin (3) remain the same as in the preferred embodiment. The hook (16) is replaced by a flexible necklace (31) which is of sufficient length to encircle the fluid reservoir (29) and ends in a small hook (32) which engages one of multiple eyes (33) located along the length of the necklace (31) proximal to the neck (2). Thus the basin is located under the tapered spout (35) by adjusting the overall length of the necklace (31). Further, to maintain the orientation of the basin (3) below the spout outlet (27), the brace (14) is bent beyond 90 degrees so that it determines the distance of the top of the neck (2) from the flared side (34) of the fluid reservoir (29).

Figure 9:
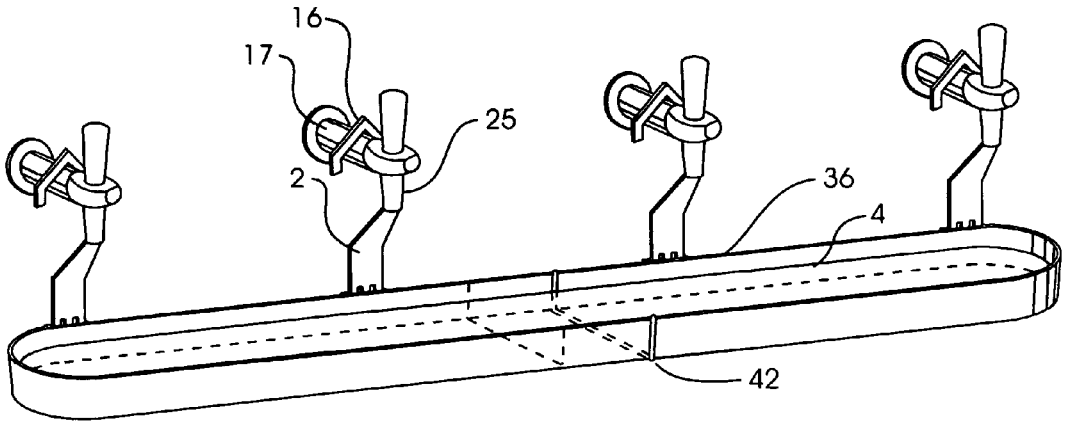
FIG. 9 is a front perspective view of an alternative embodiment of the invention for use with multiple reservoirs.
Figure 10:
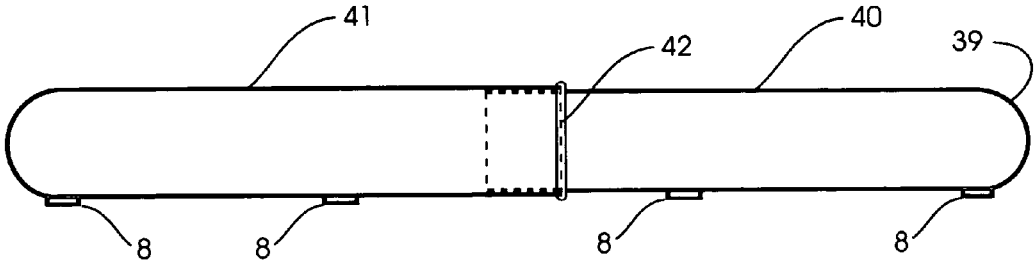
FIG. 10 is a bottom view of the alternative embodiment for use with multiple reservoirs.

A further alternative embodiment of the invention is shown in FIGS. 9 & 10. This embodiment allows the use of the invention with a bank of multiple reservoirs set side by side, each having its own spout pipe (17) and spout (25). The neck (2), brace (14) and alligator clasp (10) remain the same as in the previous embodiments. The elongated basin (36), being of rectangular shape with water tight bottom (39), is adjustably elongated (36) by means of one half of the elongated basin (36) being of smaller dimension so that the smaller section (40) slides into the larger section (41) through a water proof gasket (42) and each section has multiple slots (8) along its rear face to accommodate the alligator clasp (10) of the drip catcher neck (2). Drip catcher necks (2) are engaged into slots (8) spaced so that the elongated basin (36) is suspended from spout pipes (17) in a balanced manner.

The foregoing disclosure and description of the invention are illustrative and explanatory thereof and, it will be understood by those skilled in the art that various changes in the size, shape and materials, as well as in the details of the illustrated construction, may be made within the scope of the appended claims without departing from the scope or spirit of the invention.

I claim:

1. An improved drip catcher device, having an overall length, for removable attachment to a fluid reservoir, having an exterior face from which extends a spout pipe, having a vertical axis and diameter, which conveys fluid from the reservoir to a spout, having an outlet, and there through the fluid is discharged downward into a cup, the device being capable of being manufactured in two separate parts, a neck means comprised of a neck, having a proximal end with a hook means, having a curved shape, and a distal end having a length, comprised of two legs, each having an outside edge, with an open slot, having three sides and length and width, between, extending the length of the distal end to form an alligator clasp means, the legs having teeth with a flat top edge extending at regular intervals along the outside edge of said two legs and a basin means to which removably attaches the neck means, said drip catcher device being adjustable in length and capable of being hung from the spout pipe of the fluid reservoir, even when said spout and spout pipe are protected by a rigid protective band enclosing the spout pipe and spout, being comprised of the basin means comprised of an open cylinder of rigid, water tight material, with a closed, flat bottom and an open top of a diameter larger than that of said cup, intended to carry away the fluid, to catch drips from the spout, said cylinder having a rear wall adjacent to the reservoir which is flattened and to which is affixed a three sided slot of sufficient width to accommodate the alligator clasp means in the distal end of the neck means and having side walls extending perpendicular out from the rear wall and said side walls being no higher than the interval between the teeth on the legs of the alligator clasp means in the distal end of the neck means, and having therein a removable, disposable absorbent pad means, the neck means comprised of the hook, extending from the proximal end of the drip catcher device and displaced from the vertical axis of the spout pipe and the alligator clasp, said hook comprised of a length of rigid material having an open hook, at the proximal end of the neck means, having an inverted 'V' shape, with the apex of the 'V' at the top of the hook, inside the curve of said hook means so as to accommodate engagement of various diameter of the spout pipe while centering the spout pipe in the apex of the inverted 'V' shape so that the basin means, when attached to the distal end of the neck by means of the alligator clasp means, aligns directly below the vertical axis of the spout pipe, and the alligator clasp means in the distal end of the neck, having an integral brace means to align the basin closer to or further away from the exterior face of the fluid reservoir, so the basin is directly below the spout outlet, comprised of, in the distal end of the neck, the brace, having three sides of the brace formed by cutting free from a center of the neck, with the top of the brace remaining attached to the neck, which unattached portion of the brace is bent rearward away from the basin a sufficient distance to touch the exterior face of the fluid reservoir thereby aligning the basin with the spout outlet, while a result of removing the brace from the neck is to form a vertical adjustment means comprised of an open slot extending through the distal end of the neck thus forming the two legs extending downward in the distal end of the neck opposite from the hook, each leg is provided along the length of said each leg and extending from the outside edge of said each leg a series of teeth, spaced at regular intervals along the length of the leg paired one on each said leg, having on top of the teeth a flat face perpendicular to the open slot in the neck, top pair of said teeth, extending from the outside edge of said two legs, engage sidewalls of the three sided slot formed on the outside of the flattened rear wall of the basin, and the open slot formed in the neck by removal of the brace is of sufficient width so that the two legs when squeezed together a sufficient distance disengage the teeth from the sidewalls of the three sided slot and the three sided slot in the basin is moved up or down in relation to the teeth in the alligator clasp means to change the overall length of the drip catcher device or disassemble the basin from the neck, and the disposable absorbent pad means being comprised of a pad of such shape and size to readily fit into the basin comprised of multiple plies of absorbent material so that fluid residue caught in the basin is removed and discarded without disengaging the drip catcher device from the spout pipe of the fluid reservoir.

2. An improved drip catcher device, having an overall length, for removable attachment to a fluid reservoir, having a top, a bottom, a tapered spout, having an outlet, extending outward from the top of the fluid reservoir, and a side which flares outward from top the to the bottom, and fluid within the reservoir is conveyed from the reservoir to the spout and there through the fluid is discharge downward into a cup, the improved drip catcher device being capable of being manufactured in two separate parts, a neck means, comprised of a neck having a proximal end with a necklace means and a distal end having a length, comprised of two legs, each having an outside edge with an open slot, having three sides and length and width, between extending the length of the distal end to form an alligator clasp means, the legs having teeth with a flat top edge extending at regular intervals along the outside edge of said two legs, and a basin means, to which removably attaches the neck means, said drip catcher device being adjustable in length and capable of being hung from a flared sided fluid reservoir, being comprised of the basin means comprised of an open cylinder of rigid, water tight material, with a closed, flat bottom and an open top of a diameter larger than that of a cup, intended to carry away the fluid, to catch drips from the spout, said cylinder having a rear wall adjacent to the reservoir which is flattened and to which is affixed a three sided slot of sufficient width to accommodate the alligator clasp means in the distal end of the neck means and having side walls extending perpendicular out from the rear wall and said side walls being no higher than the interval between the teeth on the legs of the alligator clasp means in the distal end of the neck means, and having therein a removable, disposable absorbent pad means, the neck means, having a proximal end with a necklace means comprised of a length of flexible material, having a proximal end permanently attached to the neck means and an opposite end having a small hook means, extending from the proximal end of the neck means and of sufficient length to encircle the reservoir and the location of the means, from the top to the bottom of the flared sided fluid reservoir being controllable by adjusting the length of the necklace at an attachment means at the proximal end of the neck means, comprised of a plurality of eyes along the length of the necklace proximal to the neck means into which the small hook, affixed at the opposite end of the necklace means, is placed so that the necklace means, when engaged on the fluid reservoir, aligns the basin directly beneath the spout outlet, and the alligator clasp means in the distal end of the neck, having an integral brace means to align the basin, closer to or further away from the exterior face of the fluid reservoir, so the basin is directly below the spout outlet, comprised of, in the distal end of the neck, the brace, having three sides of the brace formed by cutting free from a center of the neck, with the top of the brace remaining attached to the neck, which unattached portion of the brace is bent rearward away from the basin a sufficient distance to touch the exterior face of the fluid reservoir thereby aligning the basin with the spout outlet, while a result of removing the brace from the neck is to form a vertical adjustment means comprised of an open slot extending through the distal end of the neck thus forming the two legs extending downward in the distal end of the neck opposite from the hook, each leg is provided along the length of said each leg and extending from the outside edge of said each leg a series of teeth, spaced at regular intervals along the length of the leg paired one on each said leg, having on top of the teeth a flat face perpendicular to the open slot in the neck, top pair of said teeth, extending from the outside edge of said two legs, engage sidewalls of the three sided slot formed on the outside of the flattened rear wall of the basin, and the open slot formed in the neck by removal of the brace is of sufficient width so that the two legs when squeezed together a sufficient distance disengage the teeth from the sidewalls of the three sided slot and the three sided slot in the basin is moved up or down in relation to the teeth in the alligator clasp means to change the overall length of the drip catcher device or disassemble the basin from the neck, and the disposable absorbent pad means being comprised of a pad of such shape and size to readily fit into the basin comprised of multiple plies of absorbent material so that fluid residue caught in the basin is removed and discarded without disengaging the drip catcher from the spout pipe of the fluid reservoir.

3. An improved drip catcher device, having an overall length, for removable attachment to a series or bank of multiple fluid reservoirs set side by side, each having an exterior face from which extends a spout pipe, having a vertical axis and diameter, which conveys fluid from the reservoir to a spout, having an outlet, and therethrough the fluid is discharged downward into a cup, the device being capable of being manufactured in two separate parts, a neck means comprised of a neck, having a proximal end with a hook means having a curved shape and a distal end having a length, comprised of two legs, each having an outside edge, with an open slot, having three sides and length and width between extending the length of the distal end to form an alligator clasp means, the legs having teeth with a flat top edge extending at regular intervals along the outside edge of two legs, and an elongated basin means to which removably attaches the neck means at locations along the length of the elongated basin so that the improved drip catcher device is balanced when suspended from the spout pipes of the multiple fluid reservoirs, said drip catcher device being adjustable in length and capable of being hung from the spout pipes of the fluid reservoirs, even when said spout and spout pipes are protected by a rigid protective band enclosing the spout pipe and spout, being comprised of the elongated basin means is comprised of a rectangular pan, having long front and rear sides, the rear side being adjacent to the reservoirs, and shorter end sides, and the rear side having a rear face and a front face, with water tight bottom of rigid material constructed in two halves and is adjustable in length as one half is of slightly smaller exterior dimension than the interior dimension of the other half, so that the smaller half slides into the larger half through a water proof and each half has multiple three sided slots along its rear face to accommodate the alligator clasp means in more than one three sided slot so that the elongated basin is suspended from the spout pipes in a balanced manner, and is provided with a removable, disposal absorbent pad means, the neck means comprised of the hook, extending from the proximal end of the drip catcher device and displaced from the vertical axis of the spout pipe, and the alligator clasp, said hook comprised of a length of rigid material having an open hook, at the proximal end of the neck means, having an inverted 'V' shape, with the apex of the 'V' at the top of the hook, inside the curve of said hook means so as to accommodate engagement of various diameter spout pipes while centering the spout pipe in the apex of the inverted 'V' shape so that the basin means, when attached to the distal end of the neck by means of the alligator clasp means, aligns directly below the vertical axis of the spout pipe, and the alligator clasp means in the distal end of the neck, having an integral brace means to align the basin, closer to or further away from the exterior face of the fluid reservoir, directly below the spout outlet, comprised of, in the distal end of the neck, the brace, having three sides of the brace, formed by cutting free from a center of the neck, with the top of the brace remaining attached to the neck, which unattached portion of the brace is bent rearward away from the basin a sufficient distance to touch the exterior face of the fluid reservoir thereby aligning the basin with the spout outlet, while a result of removing the brace from the neck is to form a vertical adjustment means comprised of an open slot extending through the distal end of the neck thus forming the two legs extending downward in the distal end of the neck opposite from the hook, each leg is provided along the length of said each leg and extending from the outside edge of said each leg a series of teeth spaced at regular intervals along the length of the leg, paired one on each said leg, having on top of the teeth a flat face perpendicular to the open slot in the neck, top pair of said teeth, extending from the outside edge of said two legs, engage sidewalls of the three sided slot formed on the outside of the flattened rear wall of the basin, and the open slot formed in the neck by removal of the brace is of sufficient width so that the two legs when squeezed together a sufficient distance disengage the teeth from the sidewalls of the three sided slot and the three sided slot in the basin is moved up or down in relation to the teeth in the alligator clasp means to change the overall length of the drip catcher device or disassemble the basin from the neck, and the disposable absorbent pad means being comprised of a pad of such shape and size to readily fit into the elongated basin comprised of multiple plies of absorbent material so that fluid residue caught in the basin is removed and discarded without disengaging the drip catcher device from the spout pipe of the fluid reservoir.

* * * * *